United States Patent [19]

Goyarts

[11] Patent Number: 4,640,369

[45] Date of Patent: Feb. 3, 1987

[54] SLIDE BAR MINING BOLTING MACHINE

[75] Inventor: Wynand M. Goyarts, Bristol, Tenn.

[73] Assignee: Ingersoll-Rand Company, Woodcliff Lake, N.J.

[21] Appl. No.: 669,235

[22] Filed: Nov. 7, 1984

[51] Int. Cl.[4] ..... E21C 11/02; E21D 20/00

[52] U.S. Cl. ..... 173/42; 173/23; 299/11

[58] Field of Search ..... 175/203; 299/11, 33; 173/42–45, 23, 38, 52

[56] References Cited

U.S. PATENT DOCUMENTS

| | | | |
|---|---|---|---|
| 4,199,193 | 4/1980 | Damron et al. | 299/33 X |
| 4,256,186 | 3/1981 | Barthe et al. | 299/11 X |
| 4,284,368 | 8/1981 | Albright | 299/33 X |
| 4,290,490 | 9/1981 | Barthe et al. | 173/52 X |
| 4,346,766 | 8/1982 | Manten | 173/43 X |

*Primary Examiner*—Stephen J. Novosad
*Assistant Examiner*—Michael A. Goodrin
*Attorney, Agent, or Firm*—R. J. Falkowski

[57] ABSTRACT

A mine bolter machine has a main body supported by wheels and a main drill system structure forward of the main body. The main drill support is transversely movable relative to the main body and supports a first and second drilling mechanism. The first drilling mechanism is movable to the left of the main support structure and the second drilling mechanism is movable to the right of the main support structure.

5 Claims, 6 Drawing Figures

SLIDE BAR MINING BOLTING MACHINE

This invention relates to mining bolter machines, particularly machines that have dual drilling boxes arranged to drill several holes in the roof or side of a mine without repositioning the machine.

Mining bolter machines are used to drill holes and insert roof bolts in the roofs and side walls of mines. In such operations it is desirable to be able to place the bolting machine in position and move the drill boxes to the required position for drilling the required number of holes across the width of the mine roof. This is not always possible with current mining machines if, for example, the width of the mine ceiling is such that five roof bolts are required. In this situation current mining machines require drilling three of possibly four of these holes and then repositioning for drilling the remainder.

With this invention a mining bolter machine is provided that can be placed in the center of the mine and drill the holes required without moving the machine.

The advantages of this invention will be apparent from the following description of an embodiment of the invention.

Figure 1:
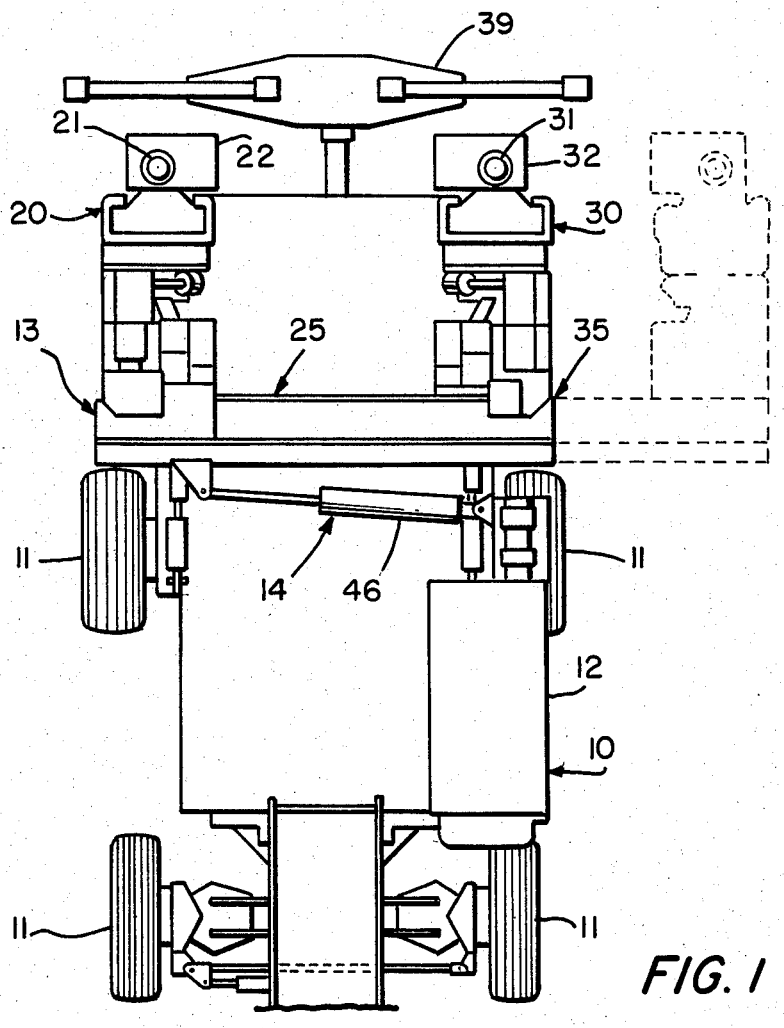
FIG. 1 is a simplified top view of a mining bolter machine according to this invention.

Referring to FIG. 1 a mining bolter machine 10 has wheels 11 for supporting and moving the machine to a position in a mine, a main body 12 of any type known in the art, and a main drill support structure 13. Drill support structure 13 is supported and connected to the main body by a means 14 for supporting and transversely moving the drill support structure. A first drilling mechanism 20 and a second drilling mechanism 30 are attached to main support structure 13 and transversely movable relative to the main support structure by a selected amount to their respective sides of and beyond the main support structure. A first drill 21 is mounted on first drilling mechanism 20 and a second drill 31 is mounted on second drilling mechanism 30.

A means 25 for transversely moving the first drilling mechanism to the left relative to the main support structure, and a means 35 for moving the second drilling mechanism to the right relative to the main support structure respectively support drills 21 and 31 and drill boxes 22 and 32 to accomplish drilling in any manner known in the art.

A temporary roof support 39 is attached to the main body and extends beyond the drill support structure and is used to support the roof during drilling operations.

Figure 6:
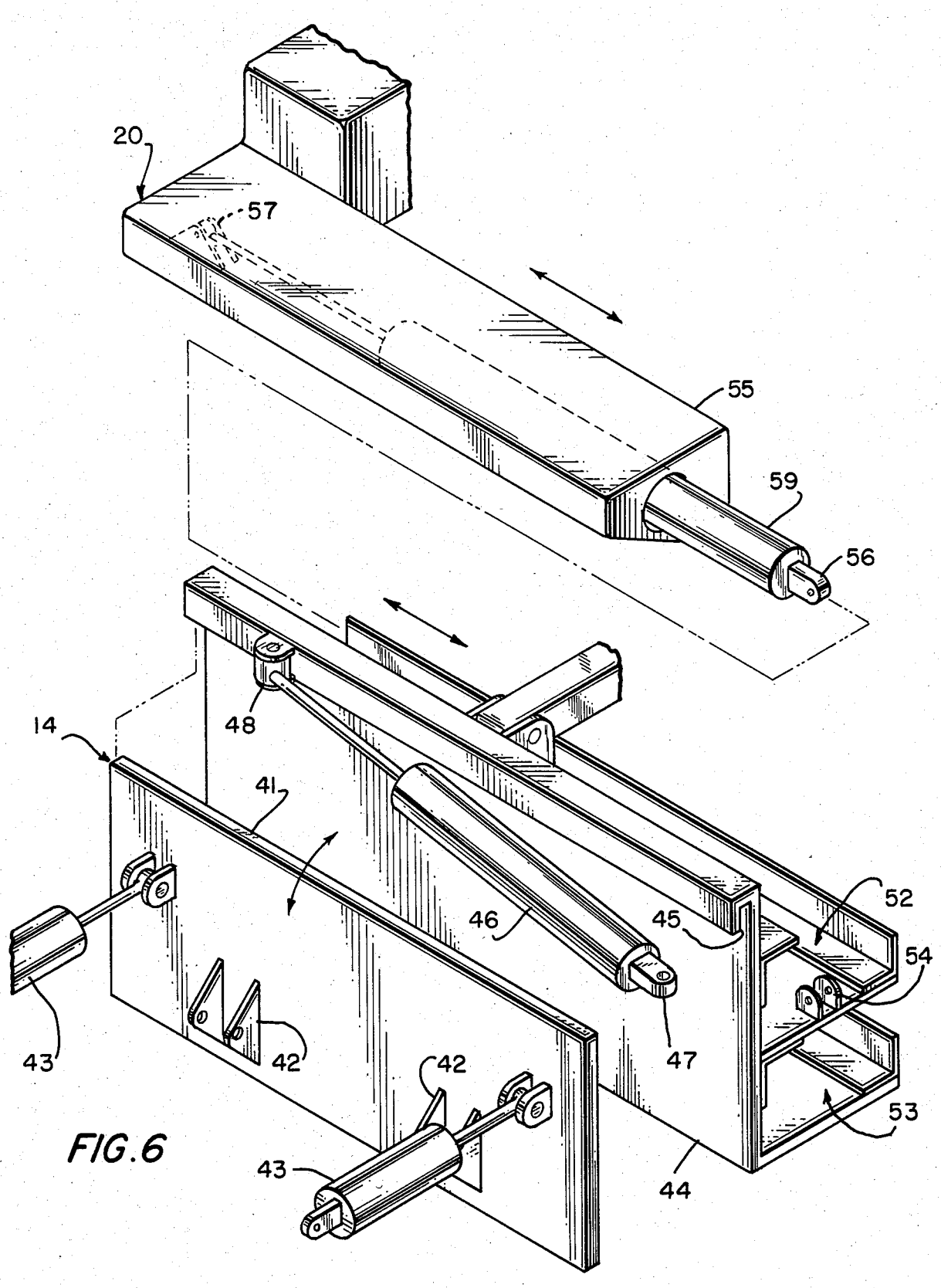
FIG. 6 is a simplified perspecitve view of a portion of the machine shown in FIG. 1.

Referring to FIG. 6, means 14 for supporting and moving the main drill support structure has a main base plate 41 connected to the main body in any manner known in the art with two connecting clevises 42 through engaging bolts and clevises on the main body (not shown) and a hydraulic cylinder 43 for positioning base plate 41 to tilt the main drill support structure. A support plate 44 has a grooved lip 45 that slidibly engages the top of main base plate 41. A hydraulic cylinder 46 is attached to the main body in any known manner (not shown) at an end 47 and is connected to support plate 44 at another end 48. Support plate 44 also has a first guiding channel 52 and a second guiding channel 53, a clevis assembly 54 in channel 52 and a similar clevis assembly (not shown) in channel 53 that are adapted to connect to hydraulic cylinders.

First drilling mechanism 20 is connected to the main support structure by a sliding mechanism comprising channel 52 in support plate 44 and a telescopically sliding section 55 adapted to be enclosed in and to slide within channel 52. A hydraulic cylinder 59 is connected to clevis assembly 54 at one end 56 and to sliding section 55 at another end 57 and is powered by a hydraulic source (not shown) to move the first drilling mechanism upon extension and contraction.

Similarly, second drilling mechanism 30 is connected to the main support structure within channel 53 and in the same manner as first drilling mechanism 20. Second drilling mechanism is substantially the mirror image of the first drilling mechanism and extends to the opposite side in the same manner.

Drill 21 and drill box 22 are mounted on the first drilling mechanism and are movable in any manner known in the art upwardly and downwardly to drill holes in the roof of a mine by moving the drill box vertically and rotating a drill to accomplish the drilling. Similarly, drill 31 and drill box 32 are mounted on the second drilling mechanism.

Means 14 for supporting and moving the main structure operates to move the main structure to the left or right as shown in FIGS. 2 through 5 by operating hydraulic cylinder 46. Drilling mechanisms 20 and 30 are movable outwardly to the left and right, respectively, and inwardly toward the center of the main structure by the operationof hydraulic cylinder 59 for mechanism 20 and its equivalent (not shown) for drilling mechanism 30.

Figure 2:
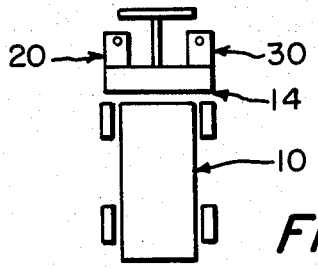
FIGS. 2, 3, 4 and 5 are schematic drawings depicting the operation of the machine shown in FIG. 1.
Figure 3:
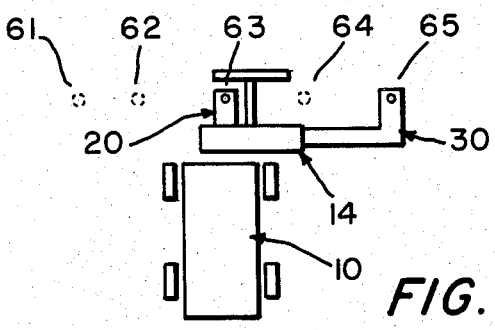
Figure 4:
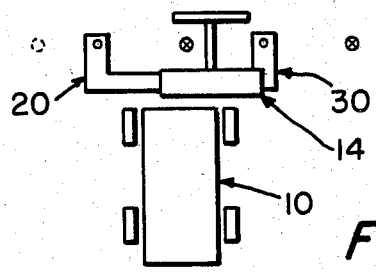
Figure 5:
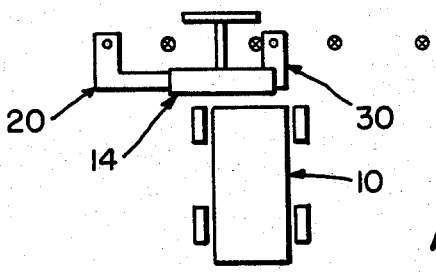

Referring to FIGS. 1 through 5, the mining bolter machine operates to move main drill support structure 13 in the directions and to the positions shown in FIGS. 2 through 5. In operation the mining bolter main body 12 moves to a position as shown in FIG. 2. In order to drill five holes 61, 62, 63, 64 and 65 the machine moves the main support structure to the right and the second drilling mechanism to the right to drill holes 63 and 65 as shown in FIG. 3. Upon drilling these holes the left drilling mechanism is moved to the left to position itself below hole 62 and the right drill support is positioned below hole 64 to accomplish the drilling as shown in FIG. 4. The main drill support structure and the first drilling support mechanism is then moved to the left as shown in FIG. 5 to place the drill underneath hole 61 and provide for drilling hole 61.

I claim:

1. A mining bolter machine comprising:

a main body;

a main drill support structure connected to the main body and transversely movable relative to the main body by a selected amount to either side of the main body;

a first drilling mechanism attached to the main support structure and transversely movable relative to the main support structure by a selected amount to one side of and beyond the main structure;

a second drilling mechanism attached to the main support structure and transversely movable relative to the main support structure by a selected amount to the other side of and beyond the main structure;

a means for transversely moving the first drilling mechanism relative to the main support structure to selected positions; and a means for transversely moving the second drilling mechanism relative to the main support structure to selected positions.

2. A mining bolter machine comprising:

a main body;

a main drill support structure connected to the main body and transversely movable relative to the main body by a selected amount to either side of the main body;

a means for transversely moving the main drill support structure relative to the main body;

a first drilling mechanism attached to the main support structure and transversely movable relative to the main support structure by a selected amount to one side of and beyond the main structure;

a second drilling mechanism attached to the main support structure and transversely movable relative to the main support structure by a selected amount to the other side of and beyond the main structure;

a first drill mounted to the first drilling mechanism and a second drill mounted on the second drilling mechanism;

a means for transversely moving the first drilling mechanism relative to the main support structure to move the first drill to selected positions; and a means for transversely moving the second drilling mechanism relative to the main support structure to move the second drill to selected positions.

3. A mining bolter machine according to claim 2 wherein said means for transversely moving the main drill support structure comprises a hydraulic cylinder connected between the main drill support mechanism and the main body.

4. A mining bolter machine according to claim 3 wherien said main drill support structure comprises a first and second channel adapted to telescopically receive sliding sections, and said first drilling mechanism comprises a sliding section adapted to telescopically move within the first channel and said second drilling mechanism comprises a sliding section adapted to telescopically move within the second channel.

5. A mining bolter machine according to claim 4 comprising a hydraulic cylinder connected between the main drill support structure and the first drilling mechanism and positioned within the first channel to move the first drilling mechanism relative to the main drill support mechanism upon extension and contraction.

* * * * *